US005679411A

United States Patent [19]

Hoppe

[11] Patent Number: 5,679,411

[45] Date of Patent: Oct. 21, 1997

[54] METHOD FOR PRODUCING A CORROSION AND WEAR RESISTANT COATING ON IRON MATERIALS

[75] Inventor: Steffen Hoppe, Overath-Rott, Germany

[73] Assignee: Metaplas Ionon Oberflächenveredelungstechnik GmbH, Bergisch Gladbach, Germany

[21] Appl. No.: 680,926

[22] Filed: Jul. 11, 1996

[30] Foreign Application Priority Data

Jul. 10, 1995 [DE] Germany ..... 195 25 182.2

[51] Int. Cl.[6] ..... C23C 14/18

[52] U.S. Cl. ..... 427/528; 427/249; 427/255.3; 427/295; 427/377; 427/529; 427/530; 427/535; 427/539; 427/569; 427/576; 427/577

[58] Field of Search ..... 427/295, 539, 427/535, 576, 577, 569, 529, 530, 528, 249, 255.3, 377

[56] References Cited

U.S. PATENT DOCUMENTS

| | | | |
|---|---|---|---|
| 4,547,228 | 10/1985 | Girrell et al. | 148/16 |
| 4,881,983 | 11/1989 | Smith et al. | 148/217 |

FOREIGN PATENT DOCUMENTS

| | | |
|---|---|---|
| 0158271 | 10/1985 | European Pat. Off. . |
| 0159222 | 10/1985 | European Pat. Off. . |
| 0217421 | 4/1987 | European Pat. Off. . |
| 0299625 | 1/1989 | European Pat. Off. . |
| 1295309 | 5/1969 | Germany . |
| 3225686 | 1/1984 | Germany . |
| 2125861 | 5/1990 | Japan . |
| 3249166 | 11/1991 | Japan . |
| 9004044 | 4/1990 | WIPO . |

OTHER PUBLICATIONS

E. J. Mittemeijer et al; Oberflächenoxidation . . . ; 1985; pp. 77–79 (No Month Available).

Li Zhi Zhang et al; A Study . . . Resistance; 1988; pp. 343–348 (No Month Available).

H. Michel et al; Mecanique Materiaux Electricite, vol. 617 No. 442, pp. 43–47 (1992) (No Month Available).

*Primary Examiner*—Bernard Pianalto
*Attorney, Agent, or Firm*—Robert W. Becker & Associates

[57] ABSTRACT

In a method for producing corrosion and wear resistant coatings on iron material, in which subsurface areas are enriched with nitrogen, carbon, and oxygen, the iron material is nitrocarburized for forming a connective coating of carbonitride. The surface of the iron material is activated with a plasma-supported vacuum process. The ion material is subsequently oxidized to form a continuous oxide coating.

7 Claims, No Drawings

METHOD FOR PRODUCING A CORROSION AND WEAR RESISTANT COATING ON IRON MATERIALS

BACKGROUND OF THE INVENTION

The present invention relates to a method for producing a corrosion and wear resistant coating on iron material in which the subsurface areas are enriched with nitrogen, carbon, and oxygen. Furthermore, the invention relates to a device for performing this method.

Since the beginning of the 1980's it is known that the corrosion and wear behavior of iron materials can be substantially improved with a subsequent oxidation of the nitride coatings. Especially favorable results can be achieved when the steps of nitrocarburization and subsequent oxidation are combined. Both method steps can be performed in gaseous as well as liquid media. The object of the subsequent oxidation of the nitride coating is the formation of a continuous oxide coating at the surface of the material.

Even though for the effective use of oxidation there is a plurality of commercially suitable technologies, the previously achieved characteristic values for the corrosion behavior of materials treated such are insufficient for a plurality of industrial applications.

Furthermore, it is disadvantageous that especially the use of salt bath methods are environmentally unsafe and the resulting surface areas are rough so that intermediate and after treatment steps must be performed.

It is therefore an object of the present invention to provide a method for producing corrosion and wear resistant coatings on iron materials which, on the one hand, eliminates the aforementioned disadvantages and, on the other hand, provides for a longer service life of the thus treated materials. Furthermore, the invention is concerned with a device for performing the inventive method.

SUMMARY OF THE INVENTION

The method for producing corrosion and wear resistant coatings on iron material in which subsurface areas are enriched with nitrogen, carbon, and oxygen, according to the present invention is primarily characterized by the following steps:

Nitrocarburizing the iron material for forming a connective coating comprised of carbonitride;

Activating the surface of the iron material with a plasma-supported vacuum process;

Oxidizing the iron material to form a continuous oxide coating.

Preferably, the step of nitrocarburization and the step of oxidizing are performed at atmospheric pressure.

Advantageously, the step of nitrocarborating includes forming at least one of the iron carbonitride selected from the group consisting of $$\epsilon\text{-}Fe_2(N,C)_{1-x}$$

and $$\delta'\text{-}Fe_4(N,C)_{1-y}.$$

The step of oxidizing preferably includes providing a nitrogen/water vapor mixture of a defined composition.

Preferably, the oxidizing step is performed in a temperature range of 480° C. to 520° C.

Preferably, the step of activating the surface includes bombarding the surface with nitrogen ions, hydrogen ions, carbon ions, and oxygen ions.

In a preferred embodiment of the present invention the nitrocarburizing, the activating, and the oxidizing steps are all performed in the same apparatus.

According to the present invention, in the method step of nitrocarburizing the subsurface areas are enriched with nitrogen and carbon in order to form a connecting coating comprised of iron carbonitrides. Surprisingly, it has been found that the corrosion and wear resistance of iron materials can be improved substantially when the iron material previously subjected to nitrocarburization is subjected to a plasma-supported vacuum process before carrying out the oxidation step. The material surface subjected to ion bombarding causes chemical and physical interactions resulting in an activation and directed change of the subsurface areas of the connective coating formed in the nitrocarburization step. Due to the ion bombardment the enrichment of the subsurface areas with oxygen during oxidation results in a continuous and uniform oxide coating on the already existing connective coating. The thus treated iron materials have a service life of up to 600 hours in standardized corrosion tests such as, for example, the salt-spray test according to DIN (German Industrial Standard) 500 21 SS.

According to a preferred embodiment of the inventive method, the method steps nitrocarburizing and oxidizing are carried out in a gas process at atmospheric pressure.

For generating an especially effective connective coating during nitrocarburization, the iron carbonitrides of the formula $$\epsilon\text{-}Fe_2(N,C)_{1-x}$$

and $$\delta'\text{-}Fe_4(N,C)_{1-y}$$

are produced by enriching the subsurface areas with nitrogen and carbon.

For forming a continuous and uniform oxide coating it is especially advantageous that for enriching the subsurface areas with oxygen the oxidation is performed in a nitrogen/water vapor mixture of a defined composition. According to a preferred embodiment of the method, the oxidation is performed in a temperature range of 480° C. to 520° C.

The activation of the iron material surface during the plasma-supported vacuum process is advantageously performed by bombarding the surface with nitrogen ions, hydrogen ions, carbon ions, and oxygen ions. With a suitable composition selection of the gas mixture for generating the aforementioned ions within the plasma, defined and directed changes within the connective coating produced in the nitrocarburization process can be achieved which also affects the subsequent oxidation step. Preferably, the nitrocarburization and oxidation as well as the plasma-supported vacuum process are performed in the same apparatus.

Due to the integration of all three method steps the inventive method, despite the additional method step of activation, can be performed in a simple and inexpensive manner.

DESCRIPTION OF PREFERRED EMBODIMENT

The object and advantages of the present invention will appear more clearly from the following specification.

The iron material to be treated is first heated to the treatment temperature of approximately 500° C. to 590° C. and subsequently subjected to a nitrocarburization process in an atmosphere consisting of ammonia, nitrogen, and carbon dioxide. The enrichment with nitrogen and carbon results in a connective coating comprised of iron carbonitrides. After completion of the nitrocarburization process performed at atmospheric pressure, the workpiece is brought to the temperature required for the oxidation step. It is also possible to perform a cooling of the workpiece to room temperature. For the subsequent plasma-supported ion bombardment of the workpiece surface area, the process chamber is evacuated. In addition to the evacuation a simultaneous heating of the workpiece to the temperature for the oxidation step is required when a previous cooling of the workpiece to room temperature took place. For producing the plasma consisting of nitrogen ions, hydrogen ions, carbon ions, and oxygen ions, the material is switched as a cathode while, for example, the apparatus wall is switched as an anode. Due to the ions which impact with high kinetic energy the surface of the workpiece, the subsurface areas of the connective coating produced in the nitrocarburization process is changed by heating, implantation, and sputtering so that in the subsequent oxidation step a continuous and uniform oxide coating is formed in an on the connective coating. The formation of the uniform oxide coating is favorably affected by the formation of the plasma over the entire surface area of the workpiece during the activation process.

After completion of the plasma process the apparatus is flooded with an inert gas at atmospheric pressure, for example, nitrogen, and the material is again heated to a treatment temperature of approximately 480° C. to 520° C. For enriching the subsurface connective coating with oxygen, water vapor for producing a nitrogen/water vapor mixture is introduced into the apparatus in order to provide oxygen for the subsequent oxidation process. After completion of the oxidation process the thus treated material is cooled by introducing nitrogen into the apparatus.

The present invention is, of course, in no way restricted to the specific disclosure of the specification and drawings, but also encompasses any modifications within the scope of the appended claims.

What I claim is:

1. A method for producing corrosion and wear resistant coatings on iron material in which subsurface areas are enriched with nitrogen, carbon, and oxygen, said method comprising the steps of:

a) nitrocarburizing an iron material for forming a nitrocarburized subsurface area;

b) activating the nitrocarburized subsurface area of the iron material with a plasma-supported vacuum process for forming an activated nitrocarburized subsurface area;

c) oxidizing the activated nitrocarburized subsurface area of the iron material to form a continuous oxide coating.

2. A method according to claim 1, wherein step a) and step c) include providing atmospheric pressure.

3. A method according to claim 1, wherein step a) includes forming at least one of the iron carbonitrides selected from the group consisting of $\epsilon$–$Fe_2(N, C)_{1-x}$ and $\delta'$–$Fe_4(N, C)_{1-y}$.

4. A method according to claim 1, wherein step c) includes providing a nitrogen/water vapor mixture of a defined composition.

5. A method according to claim 1, wherein step c) includes providing a temperature range of 480° C. to 520° C.

6. A method according to claim 1, wherein step b) includes bombarding the surface with nitrogen ions, hydrogen ions, carbon ions, and oxygen ions.

7. A method according to claim 1, wherein step a), step b), and step c) are performed in one apparatus.

* * * * *